US011832642B2

(12) United States Patent
Johns et al.

(10) Patent No.: US 11,832,642 B2
(45) Date of Patent: Dec. 5, 2023

(54) PIPE AND CARTRIDGE FOR A SMOKABLE MEDIA

(71) Applicant: Johns Family Irrevocable Trust, Allen, TX (US)

(72) Inventors: Benjamin Michael Johns, Allen, TX (US); Benjamin Adam Johns, Parker, TX (US)

(73) Assignee: Johns Family Irrevocable Trust, Allen, TX (US)

( * ) Notice: Subject to any disclaimer, the term of this patent is extended or adjusted under 35 U.S.C. 154(b) by 0 days.

(21) Appl. No.: 17/449,141

(22) Filed: Sep. 28, 2021

(65) Prior Publication Data

US 2023/0102534 A1 Mar. 30, 2023

(51) Int. Cl.

| | |
|---|---|
| ***A24D 1/14*** | (2006.01) |
| ***B65B 1/04*** | (2006.01) |
| ***B65B 1/02*** | (2006.01) |
| ***A24F 3/00*** | (2006.01) |

(52) U.S. Cl.

CPC ..... *A24D 1/14* (2013.01); *A24F 3/00* (2013.01); *B65B 1/02* (2013.01); *B65B 1/04* (2013.01)

(58) Field of Classification Search

CPC ..... A24D 1/14; A24F 3/00; A24F 3/02

See application file for complete search history.

(56) References Cited

U.S. PATENT DOCUMENTS 2,258,933 A 10/1941 Knob
2,263,935 A * 11/1941 Sullivan ..... A24F 1/00 131/203
2,307,573 A 1/1943 Cullen
2,937,648 A 5/1960 Meyer
3,292,634 A * 12/1966 Beucler ..... A24D 1/14 131/183
3,468,314 A * 9/1969 Palmer ..... A24D 1/14 131/204
3,791,390 A * 2/1974 Hendricks ..... A24F 5/04 131/196
4,294,267 A * 10/1981 Glymph ..... A24F 1/00 131/179
4,944,317 A 7/1990 Thal (Continued)

FOREIGN PATENT DOCUMENTS

| | | | |
|---|---|---|---|
| DE | 693784 | C | 7/1940 |
| FR | 704954 | A | 5/1931 |
| WO | 2021014388 | A1 | 1/2021 |

*Primary Examiner* — Galen H Hauth

*Assistant Examiner* — Yana B Krinker

(74) *Attorney, Agent, or Firm* — Scheef & Stone, LLP; Keith C. Rawlins

(57) ABSTRACT

A pipe and cartridge for smokable media are disclosed. The pipe and cartridge can be used in combination as a pipe and cartridge system. The cartridge is configured to hold an amount of smokable medium, can be sealed on top and bottom to maintain freshness of the smokable medium prior to consumption, and has a side wall configured such that a space for heat convection is formed between the side wall and a side wall of a recess of a pipe. The pipe can include a body, a recess configured to hold the cartridge such that a space for heat convection is formed between the side wall of the recess and the side wall of the cartridge, a channel formed in the body and that extends from a bottom of the recess to a side wall of the body, and an optional lid.

19 Claims, 4 Drawing Sheets

(56) References Cited

U.S. PATENT DOCUMENTS

| | | | | |
|---|---|---|---|---|
| 7,717,259 | B2 * | 5/2010 | Hatton | A24F 15/18 206/86 |
| 2016/0324211 | A1 * | 11/2016 | Yankelevich | A24F 1/00 |
| 2020/0253281 | A1 | 8/2020 | Rogan et al. | |
| 2021/0037882 | A1 | 2/2021 | Barenboym | |
| 2021/0169142 | A1 | 6/2021 | Fernando et al. | |

* cited by examiner

PIPE AND CARTRIDGE FOR A SMOKABLE MEDIA

FIELD OF THE DISCLOSURE

The present disclosure generally relates to smoking apparatus, and more particularly to a pipe and a cartridge for use with smokable media.

BACKGROUND

Usage of cannabis has become more common, for example, in recreational smoking and for managing symptoms related to medical issues. Cannabis dispensaries can provide a customer or patient with cannabis; however, the dispensaries may not divide the cannabis into known dosages or serving sizes of active ingredient. Moreover, determining the amount of active ingredient on the consumer/patient end can be a challenge because different varieties of cannabis can have different concentrations of active ingredients; thus, weighing cannabis can be an unreliable method for determining the amount of active in a given mass of cannabis. Not knowing the amount of active ingredient in a given mass of cannabis can also cause problems for interstate travel. Knowing the dosage or service size can also be a challenge for other smokable media such as tobacco, for example, when smoking the smokable media in a pipe.

SUMMARY

Disclosed herein are a pipe and cartridge for smokable media.

The pipe can include a recess formed in a top surface of the pipe body, wherein the recess is configured to hold a cartridge containing the smokable medium such that a space is formed between a side wall of the recess and a side wall of the cartridge; a channel formed in the body and extending from a bottom of the recess and extending a length of the pipe body to an opening formed in a side wall of the pipe body; and a lid configured to cover the top surface of the pipe body, wherein the lid can be placed on the top surface of the pipe body such that the hole is placed over the recess.

The cartridge can include a body with at least one side wall and a bottom surface connected to a lower end of the at least one side wall, wherein an access opening is formed in a top of the body such that the access opening exposes a hollow interior of the body, wherein a hole is formed in the bottom surface, and wherein the hollow interior is configured to receive the smokable medium; a top cover placed over the access opening of the body; and a bottom cover placed over the hole of the bottom surface; wherein the body of the cartridge is made of a material configured to tolerate combustion of the smokable medium within the cartridge.

The pipe and cartridge can be used in combination as a pipe and cartridge system.

Other technical features may be readily apparent to one skilled in the art from the following figures, descriptions and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

Disclosed herein are a pipe and cartridge for smokable media, a pipe and cartridge system, and a method for making the cartridge. Use of a cartridge provides for consumption of a controlled and measured amount of smokable media and/or active ingredient of the smokable media. It was found that a problem associated with combusting a smokable medium in a pipe and cartridge system, and particularly for smokable media where deep inhalation is performed (e.g., for smoking cannabis), was that the smoke was uncomfortably hot in the lungs. It has been found that the disclosed pipe and cartridge configurations produce a cooler combustion temperature of smokable medium in the cartridge, which produces a cooler smoke that is more comfortable for deep inhalation of the smoke. The cooler smoke can also prevent lung discomfort and/or damage caused by hot smoke.

"Smokable media" or "smokable medium" as used herein refers to known smokable materials, typically plant based, such as tobacco, cannabis, hemp, or combinations thereof.

FIGS. 1A, 1B, 2A, 2B, 3A, 3B, 4A, and 4B illustrate various embodiments of the disclosed cartridge. The cartridge is generally configured to hold a measured amount of a smokable medium, so that the amount of active contained in the cartridge such as nicotine or tetrahydrocannabinol (THC) that is consumed can be known. Thus, a consumer can buy multiple cartridges of smokable medium in a package containing multiple cartridges, and have the same serving amount of active contained in each cartridge. Moreover, the disclosed pipe can be designed to interchangeably receive cartridges so that one consumed cartridge can be exchanged for another, while still knowing the serving amount of active consumable in each cartridge.

Figure 1A:
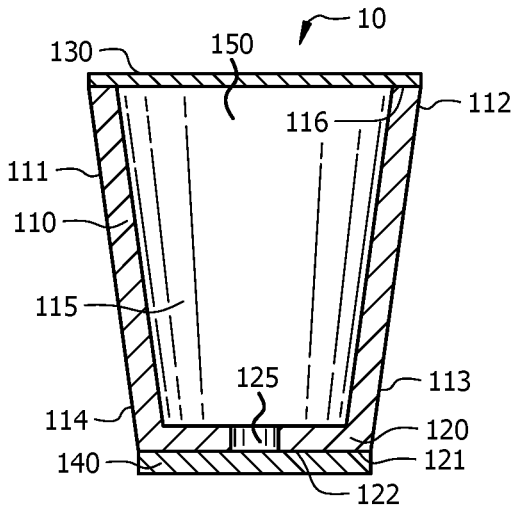
FIG. 1A depicts a cross-sectional view of a cartridge according to the disclosure.
Figure 1B:
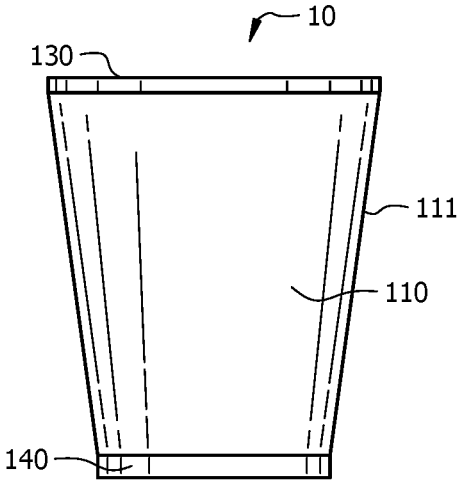
FIG. 1B depicts a side view of the cartridge of FIG. 1A.

FIGS. 1A and 1B depict a cross-sectional view and a side view, respectively, of an embodiment of a cartridge 10 according to the disclosure. The cartridge 10 can have a body 110, a top cover 130 attached to a top 112 of the body 110, and a bottom cover 140 attached to a bottom 113 of the body 110.

The body 110 includes a side wall 111 and a bottom surface 120 that can be connected to a lower end 114 of the side wall 111. An access opening 150 is formed in the top 112 of the body 110 such that a hollow interior 115 of the body 110 is accessible once the top cover 130 is removed.

In FIGS. 1A and 1B, the side wall 111 is illustrated as a circular cross-section when viewed from top to bottom or bottom to top; however, it is contemplated that the side wall 111 can be embodied as more than one side wall, for example, a plurality of walls having a triangular, square, pentagonal, hexagonal, or otherwise polygonal cross-section when viewed from top to bottom or bottom to top. The side wall 111 (or side walls in other embodiments having multiple side walls) can each be straight, concave, convex, or a combination thereof.

The bottom surface 120 of the body 110 can have a hole 125 form therein. In FIG. 1A, the hole 125 is formed in the center of the bottom surface 120. A screen or mesh material can be placed in the hole 125 to prevent smokable medium from falling out of the cartridge 10 when placed in a pipe. The hole 125 can be embodied as a circular hole; alternatively, the hole 125 can be embodied as any shaped opening or plurality of openings (e.g., slots) through which smoke can travel out of the cartridge 10. In embodiments, the bottom surface 120 is formed integrally of the same material as the side wall 111. In embodiments, the bottom surface 120 can be concave, convex, or straight.

The cartridge 10 can also have a top cover 130 connected to a top surface 116 of the side wall 111. The top cover 130 can be configured to cover the access opening 150 and be releasably attached to the side wall 111. The top cover 130 can be formed of a plastic material (e.g., polyethylene, polypropylene, or a combination thereof) or metal material (e.g., foil of aluminum, copper, bronze, or a combination thereof) with adhesive placed around the perimeter of the top cover 130 for attachment to the top surface 116 of the side wall 111. The adhesive is configured to maintain an airtight seal between the top cover 130 and the cartridge 10.

The cartridge 10 can have a bottom cover 140 connected to the bottom surface 120 such that the hole 125 and the hollow interior 115 of the body 110 are sealed from the atmosphere when the bottom cover 140 is attached. The bottom cover 140 can be configured to cover the hole 125 in the bottom surface 120 and be removeable from the bottom surface 120. The bottom cover 140 can be releasably attached to the bottom surface 120, for example, to a perimeter 121 of the bottom surface 120 and/or to a portion 122 of the bottom surface 120 that defines a perimeter of the hole 125. The bottom cover 140 can be formed of a plastic material (e.g., polyethylene, polypropylene, or a combination thereof) or metal material (e.g., foil of aluminum, copper, bronze, or a combination thereof) with adhesive placed around the perimeter of the bottom cover 140 for attachment to the bottom surface 120 of the body 110. The adhesive is configured to maintain an airtight seal between the bottom cover 140 and the cartridge 10.

The top cover 130, the bottom cover 140, or both can be labeled with indications or writing (e.g., product and dosage information) or other form of communicable information (e.g., QR code or bar code) so that the consumer of the cartridge 10 can know the amount of smokable medium, active ingredient, or other characteristic of the product in the cartridge 10.

In embodiments, the cartridge 10 can have a diameter range from about 0.5 cm to about 1.5 cm. In additional embodiments, the top 112 of the body 110 can have a diameter that is greater than a diameter of the bottom 113 of the body 110. In embodiments, the top 112 of the body 110 can have a diameter in the range of about 1 cm to 5 cm and the bottom 113 of the body 110 can have a diameter in the range of about 0.5 cm to 4 cm. In other embodiments, the top 112 and bottom 113 of the body 110 can have the same diameter. In embodiments, the body 110 can have a thickness (for the side wall 111 and bottom surface 120) in the range of from about 0.01 mm to 1 mm. The hole 125 can have a diameter in the range 0.1 mm to 1 cm, where the diameter of the hole 125 is less than the diameter of the bottom 113 of the body 110.

The body 110 can be made of metal such as aluminum, copper, bronze, zinc, or a combination thereof.

When packing a smokable medium in the cartridge 10, a smokable medium can be inserted through the access opening 150 and into hollow interior 115 of the body 110. The top cover 130 can then be placed over the access opening 150, and the top cover 130 can be sealed against the top surface 116 of the side wall 111. When consuming a smokable medium in the cartridge 10, the top cover 130 and the bottom cover 140 can be removed by the consumer to expose the smokable medium to the atmosphere for placement in the disclosed pipe.

Figure 2A:
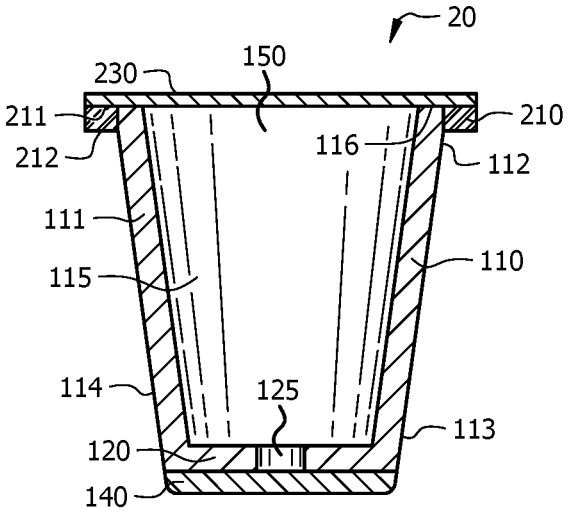
FIG. 2A depicts a cross-sectional view of an alternative embodiment of a cartridge according to the disclosure.
Figure 2B:
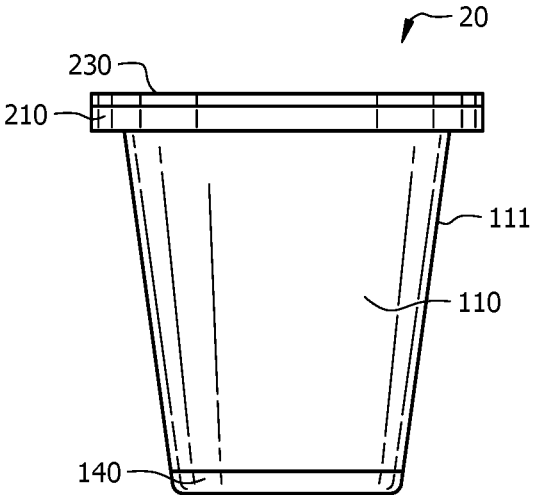
FIG. 2B depicts a side view of the cartridge of FIG. 2A.

FIGS. 2A and 2B depict a cross-sectional view and a side review, respectively, of another embodiment of a cartridge 20. The cartridge 20 has the body 110 and bottom cover 140 similar to the cartridge 10 in FIGS. 1A and 1B, and the description is not reproduced here. The cartridge 20 additionally has a lip 210 attached to the top 112 of the side wall 111 of the body 110. In FIGS. 2A and 2B, the lip 210 extends radially outwardly from the side wall 111; however, it is contemplated that the lip 210 can be positioned on the top surface 116 of the side wall 111 and extend radially outwardly relative to a longitudinal axis of the cartridge 20. In embodiments, the lip 210 can be embodied as a ring-shaped piece of material that is made of the same material as the body 110, and in some embodiments, integrally formed with the body 110. A bottom surface 212 of the lip 210 is configured to rest on a ledge of the disclosed pipe when inserted into the pipe.

A top cover 230 can be connected to a top surface or perimeter 211 of the lip 210 such that the top cover 230 covers the access opening 150 and seals the smokable medium in the hollow interior 115 of the body 110. Additionally or alternatively, the top cover 230 can be connected to the top surface 116 of the side wall 111. The top cover 230 can be configured to cover the access opening 150 and be releasably attached to the top surface or perimeter 211 of the lip 210, to the top surface 116 of the side wall 111, or to both. The top cover 230 can be formed of a plastic material (e.g., polyethylene, polypropylene, or a combination thereof) or metal material (e.g., foil of aluminum, copper, bronze, or a combination thereof) with adhesive placed around the perimeter of the top cover 230 for attachment and seal. The top cover 230, the bottom cover 140, or both, can be labeled with indications or writing (e.g., product and dosage information) or other form of communicable information (e.g., QR code or bar code) so that the consumer of the cartridge 20 can know the amount of smokable medium, active ingredient, or other characteristic of the product in the cartridge 20.

Cartridge 20 can also have the bottom cover 140 as discussed for the cartridge 10.

When packing a smokable medium in the cartridge 20, a smokable medium can be inserted through the access opening 150 and into hollow interior 115 of the body 110. The top cover 230 can then be placed over the access opening 150, and the top cover 230 can be sealed against the top surface or perimeter 211 of the lip 210, to the top surface 116 of the side wall 111, or to both. When consuming a smokable medium in the cartridge 20, the top cover 230 and the bottom cover 140 can be removed by the consumer to expose the smokable medium to the atmosphere for placement in the disclosed pipe.

Figure 3A:
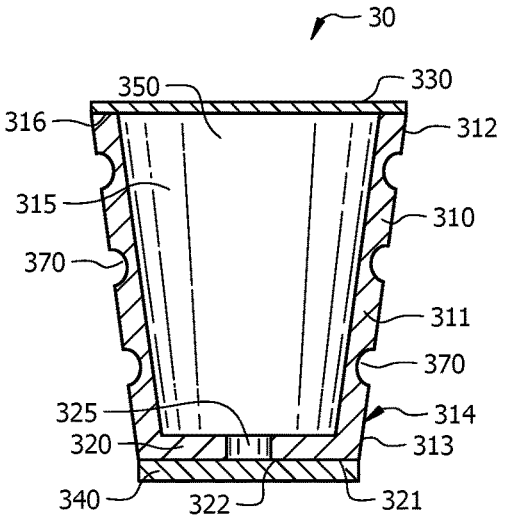
FIG. 3A depicts a cross-sectional view of an alternative embodiment of a cartridge according to the disclosure.
Figure 3B:
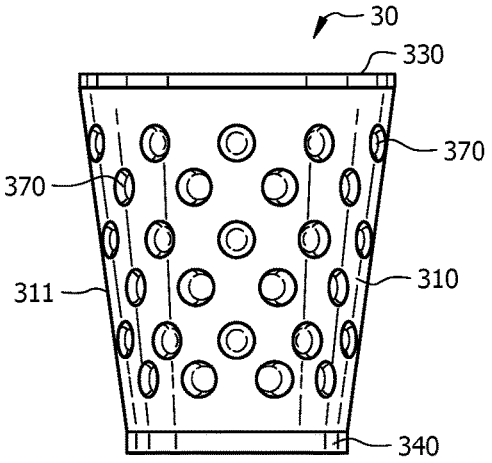
FIG. 3B depicts a side view of the cartridge of FIG. 3A.
Figure 4A:
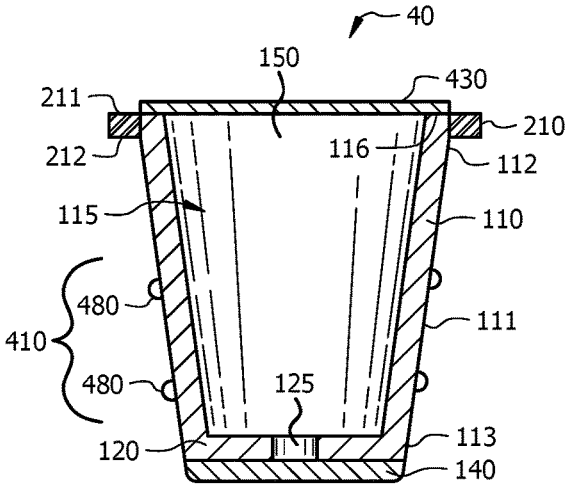
FIG. 4A depicts a cross-sectional view of an alternative embodiment of a cartridge according to the disclosure.
Figure 4B:
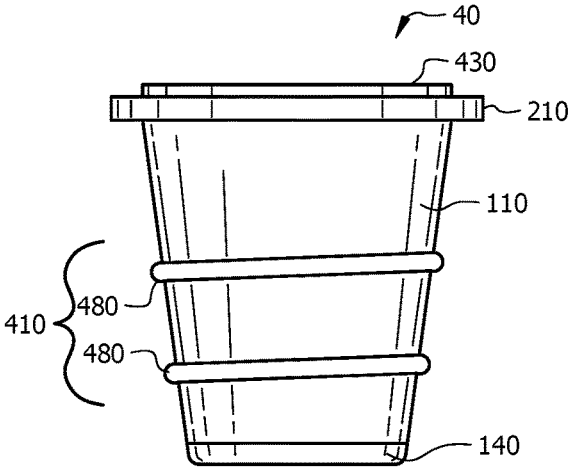
FIG. 4B depicts a side view of the cartridge of FIG. 4A.

FIGS. 3A, 3B, 4A, and 4B disclosed embodiments of cartridges having heat transfer elements form on or otherwise attached to the side wall of the cartridge. The heat transfer elements in FIGS. 3A and 3B are referred to as indentations, and the heat transfer elements in FIGS. 4A and 4B are referred to as protrusions.

FIGS. 3A and 3B depict a cross-sectional view and a side view, respectively, of another embodiment of a cartridge 30.

The cartridge 30 can have a body 310, a top cover 330 attached to a top 312 of the body 310, and a bottom cover 340 attached to a bottom 313 of the body 310.

The body 310 includes a side wall 311 and a bottom surface 320 that can be connected to a lower end 314 of the side wall 311. An access opening 350 is formed in the top 312 of the body 310 such that a hollow interior 315 of the body 310 is accessible once the top cover 330 is removed.

In FIGS. 3A and 3B, the side wall 311 is illustrated as a circular cross-section when viewed from top to bottom or bottom to top; however, it is contemplated that the side wall 311 can be embodied as more than one side wall, for example, a plurality of walls having a triangular, square, pentagonal, hexagonal, or otherwise polygonal cross-section when viewed from top to bottom or bottom to top. The side wall 311 (or side walls in other embodiments having multiple side walls) can each be straight, concave, convex, or a combination thereof.

The bottom surface 320 of the body 310 can have a hole 325 form therein. In FIG. 3A, the hole 325 is formed in the center of the bottom surface 320. A screen or mesh material can be placed in the hole 325 to prevent smokable medium from falling out of the cartridge 10 when placed in a pipe. The hole 325 can be embodied as a circular hole; alternatively, the hole 325 can be embodied as any shaped opening or plurality of openings (e.g., slots) through which smoke can travel out of the cartridge 30. In embodiments, the bottom surface 320 is formed integrally of the same material as the side wall 311. In embodiments, the bottom surface 320 can be concave, convex, or straight.

The cartridge 30 can also have a top cover 330 connected to a top surface 316 of the side wall 111. The top cover 330 can be configured to cover the access opening 150 and be releasably attached to the side wall 111. In alternative embodiments, it is contemplated that the cartridge 30 can be configured with a lip, such as that discussed for the cartridge 20 in FIGS. 2A and 2B. In these alternative embodiments, it is contemplated that the top cover 330 can be configured to cover the access opening 350 and be releasably attached to the top surface or perimeter of the lip, to the top surface 316 of the side wall 311, or to both. The top cover 330 can be formed of a plastic material (e.g., polyethylene, polypropylene, or a combination thereof) or metal material (e.g., foil of aluminum, copper, bronze, or a combination thereof) with adhesive placed around the perimeter of the top cover 330 for attachment.

The cartridge 30 can have a bottom cover 340 connected to the bottom surface 320 such that the hole 325 and the hollow interior 315 of the body 310 are sealed from the atmosphere when the bottom cover 340 is attached. The bottom cover 340 can be configured to cover the hole 325 in the bottom surface 320 and be removeable from the bottom surface 320. The bottom cover 340 can be releasably attached to the bottom surface 320, for example, to a perimeter 321 of the bottom surface 320 and/or to a portion 322 of the bottom surface 320 that defines a perimeter of the hole 325. The bottom cover 340 can be formed of a plastic material (e.g., polyethylene, polypropylene, or a combination thereof) or metal material (e.g., foil of aluminum, copper, bronze, or a combination thereof) with adhesive placed around the perimeter of the bottom cover 340 for attachment to the bottom surface 320 of the body 310.

The top cover 330, the bottom cover 340, or both, can be labeled with indications or writing (e.g., product and dosage information) or other form of communicable information (e.g., QR code or bar code) so that the consumer of the cartridge 30 can know the amount of smokable medium, active ingredient, or other characteristic of the product in the cartridge 30.

In embodiments, the cartridge 30 can have a diameter range from about 0.5 cm to about 1.5 cm. In additional embodiments, the top 312 of the body 310 can have a diameter that is greater than a diameter of the bottom 313 of the body 310. In embodiments, the top 312 of the body 310 can have a diameter in the range of about 1 cm to 5 cm and the bottom 313 of the body 310 can have a diameter in the range of about 0.5 cm to 4 cm. In other embodiments, the top 312 and bottom 313 of the body 310 can have the same diameter. In embodiments, the body 310 can have a thickness (for the side wall 311 and bottom surface 320) in the range of from about 0.01 mm to 1 mm. The hole 325 can have a diameter in the range 0.1 mm to 1 cm, where the diameter of the hole 325 is less than the diameter of the bottom 313 of the body 310.

The body 310 can be made of metal such as aluminum, copper, bronze, or a combination thereof. In embodiments, the material from which the body 310 is formed can be a heat conductive material, such as a metal comprising aluminum.

In FIGS. 3A and 3B, it can be seen that the wall 311 has indentations 370 formed therein. The indentations 370 can be circular in shape, resembling dimples, or have any other shape. For example, the indentations 370 can be long vertical indentations giving an appearance of ribs on the side wall 311. The indentations 370 increase the surface area of the wall 311 compared to a wall 311 with a smooth outer surface. The increased surface area provides a greater area for heat transfer out of the cartridge 30 when smokable medium is combusted in the hollow interior 315 of the cartridge 30. Without being limited by theory, it is believed that smokable medium combusted in a cartridge 30 formed with indentations 370 in the side wall 311 produces a cooler smoke than combustion in a cartridge that has a side wall (e.g., side wall 111) without the indentations 370. It is believed that the increased surface area of the of the side wall 311 increases the heat transfer of smokable medium combustion heat through the side wall 311 and out of the cartridge 30, which provides a lower combustion temperature for the smokable medium in the cartridge 30. The lower combustion temperature produces a cooler smoke. The cooler temperature of the smoke is particularly noticeable for smoke that is inhaled, such as cannabis smoke, and makes for a more pleasurable consumption experience.

When packing a smokable medium in the cartridge 30, a smokable medium can be inserted through the access opening 350 and into hollow interior 315 of the body 310. The top cover 330 can then be placed over the access opening 350, and the top cover 330 can be sealed against the top surface 316 of the side wall 311. When consuming a smokable medium in the cartridge 30, the top cover 330 and the bottom cover 340 can be removed by the consumer to expose the smokable medium to the atmosphere for placement in the disclosed pipe.

FIGS. 4A and 4B depict a cross-sectional view and a side view, respectively, of an alternative embodiment of a cartridge 40 according to the disclosure. The cartridge 40 has a body 110, bottom cover 140, and lip 210 as described for FIGS. 2A and 2B, so this description is not reproduced here.

FIGS. 4A and 4B illustrate an embodiment in which the top cover 430 is attached to the top surface 116 of the side wall 111 and not to the top surface of the lip 210. The top cover 430 can be configured to cover the access opening 150 and be releasably attached to the side wall 111. The top cover 430 can be formed of a plastic material (e.g., polyethylene, polypropylene, or a combination thereof) or metal material (e.g., foil of aluminum, copper, bronze, or a combination thereof) with adhesive placed around the perimeter of the top cover 430 for attachment to the top surface 116 of the side wall 111. The top cover 430, the bottom cover 140, or both, can be labeled with indications or writing (e.g., product and dosage information) or other form of communicable information (e.g., QR code or bar code) so that the consumer of the cartridge 40 can know the amount of smokable medium, active ingredient, or other characteristic of the product in the cartridge 40.

The cartridge 40 has heat transfer protrusions 480 (e.g., ridges, fins, etc.) attached to or integrally formed with an outer surface of the side wall 111. The heat transfer protrusions 480 can extend radially outwardly from an outer side of the side wall 111. The heat transfer protrusions 480 can be configured to increase the surface area of side wall 111. The heat transfer protrusions 480 can be of any shape and number and configuration. For example, although the heat transfer protrusions 40 appear as horizontally ringed-fins in FIGS. 4A to 4B, it is contemplated that the heat transfer protrusions 480 can additionally or alternatively extend vertically with respect to the view in FIGS. 4A and 4B. In embodiments as depicted in FIGS. 4A to 4B, heat transfer protrusions 480 are formed on a lower portion 410 of the body 110. Forming heat transfer protrusions 480 on the lower portion 410 of the body 110 allows the cartridge 40 to be inserted into a pipe without disturbing the shape of the heat transfer protrusions 480, and the lip 210 can rest on a ledge in the pipe. The lip 210 can help to provide clearance for the heat transfer protrusions 480 and to hold the cartridge 40 in a pipe such that the side wall 111 does not touch the side wall of a recess formed in the pipe (discussed in more detail below), which keeps the heat transfer protrusions 480 in a configuration for maximum heat transfer surface area within a pipe.

The heat transfer protrusions 480 increase the surface area of the wall 111 compared to a wall 111 with a smooth outer surface (e.g., wall 111 of FIGS. 1A, 1B, 2A, and 2B). The increased surface area provides are a greater area for heat transfer out of the cartridge 40 when smokable medium is combusted in the hollow interior 115 of the cartridge 40. Without being limited by theory, it is believed that smokable medium that is combusted in a cartridge 40 formed with heat transfer protrusions 480 in the side wall 111 has a cooler smoke than combination in a cartridge that has a side wall (e.g., side wall 111) without the heat transfer protrusions 480. It is believed that the increased surface area of the of the side wall 111 having heat transfer protrusions 480 thereon increases the heat transfer of smokable medium combustion heat through the side wall 111 and heat transfer protrusions 480 and out of the cartridge 40, which provides a lower combustion temperature for the smokable medium in the cartridge 40. The lower combustion temperature produces a cooler smoke. The cooler temperature of the smoke is particularly noticeable for smoke that is inhaled, such as cannabis smoke, and makes for a more pleasurable consumption experience.

When packing a smokable medium in the cartridge 40, a smokable medium can be inserted through the access opening 150 and into hollow interior 115 of the body 110. The top cover 430 can then be placed over the access opening 150, and the top cover 430 can be sealed against the top surface 116 of the side wall 111. When consuming a smokable medium in the cartridge 40, the top cover 430 and the bottom cover 140 can be removed by the consumer to expose the smokable medium to the atmosphere for placement in the disclosed pipe.

It should be understood that all of the features depicted in the embodiments in FIGS. 1A, 1B, 2A, 2B, 3A, 3B, 4A, and 4B can be combined in other embodiments. For example, an embodiment of a cartridge can include a lip 210 of cartridge 20 in combination with indentations 370 of cartridge 30 or protrusions 480 of cartridge 40.

Figure 5:
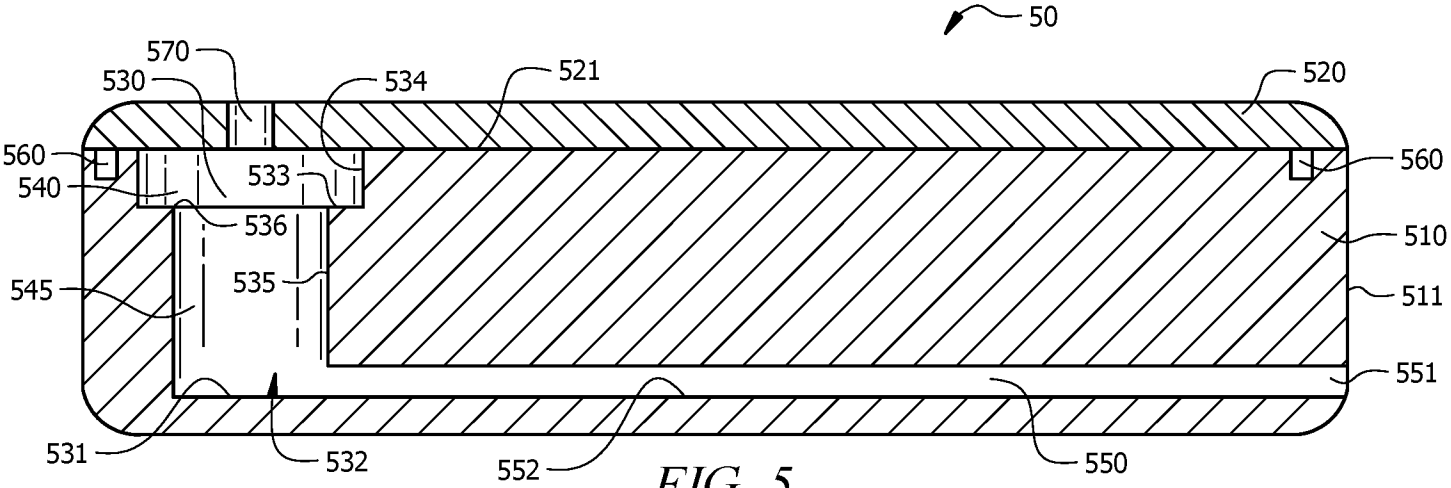
FIG. 5 depicts a cross-sectional view of an embodiment of a pipe according to the disclosure.
Figure 6:
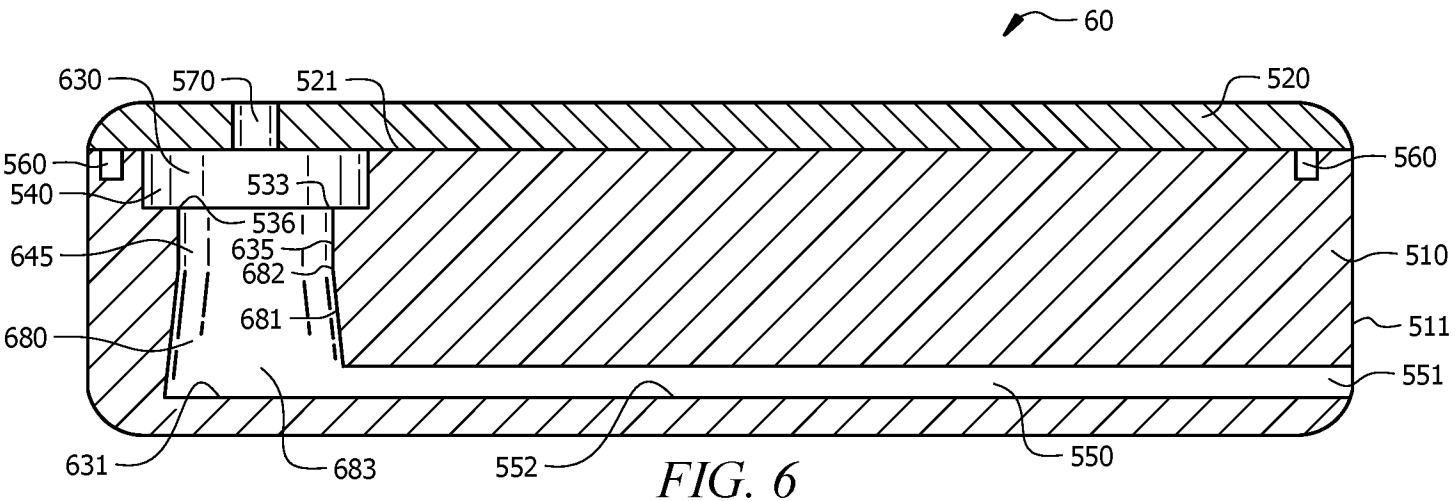
FIG. 6 depicts a cross-sectional view of an alternative embodiment of a pipe according to the disclosure.
Figure 7:
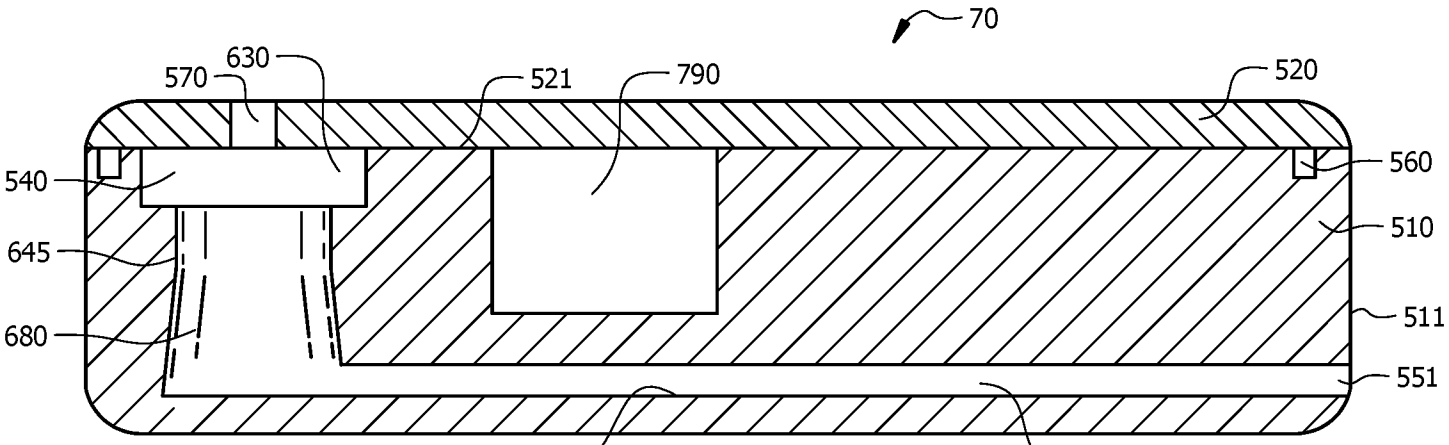
FIG. 7 depicts a cross-sectional view of an alternative embodiment of a pipe according to the disclosure.

FIGS. 5-7 depict embodiments of a pipe according to the disclosure. Certain features of the pipe are common to all embodiments and will be described in respect to FIG. 5. Features unique to certain embodiments will be described later.

The pipe 50 in FIG. 5 has a body 510 and an optional lid 520.

The body 510 can have a recess 530 formed in a top surface 521 of the pipe body 510. The recess 530 can have a first portion 540 and a second portion 545 below the first portion 540. The first portion 540 can have a larger diameter than the second portion 545 such that a ledge 533 is formed at the bottom of the first portion 540. In FIG. 5 the side wall 534 of the first portion 540 is cylindrical in shape with a first diameter, and the side wall 535 of the second portion 545 is cylindrical in shape with a second diameter that is less than the second diameter such that the ledge 533 is formed where the first portion 540 meets the second portion 545. In alternative embodiments, the side wall 535 of the second portion 545 can be angled or tapered relative to a side wall of a cartridge placed in the recess 530. For example, the side wall 535 can be substantially vertical while the side wall of a cartridge is tapered, the side wall 535 can be angled or tapered such that a top of the second portion 545 has a diameter that is less than a diameter of the bottom of the second portion 545, or both.

The recess 530 can be configured to accept any of the cartridges 10, 20, 30, and 40 described above. Using cartridges 10 and 30 as examples, the recess 530 can be configured such that point 536 where the ledge 533 and the side wall 535 meet provides a support surface for the side wall 111 and 311 of the cartridges 10 and 30, respectively. The contact between the side walls 111 and 311 with the point 536 holds the cartridges 10 and 30 in the recess 530. Using cartridges 20 and 40 as examples, the recess 530 can be configured such that the ledge 533 provides a support surface for the lip 210 of cartridges 20 and 40. The contact between the lip 210 and the ledge 533 holds the cartridges 20 and 40 in the recess 530.

In embodiments, the bottom surface 120 of cartridges 10, 20, and 40 does not touch a bottom surface 531 of the recess 530. In embodiments, the bottom surface 320 of cartridge 30 does not touch the bottom surface 531 of the recess 530.

In embodiments, the bottom surface 531 of the recess 530 can have indentations (for example, as described for the cartridge 30) formed therein so as to increase the contact surface area of the smoke with the bottom surface 531. Indentations can contribute to a cooling effect of the smoke in the recess 530 by conducting heat through the body 510 of the pipe 50.

The second portion 545 is designed to allow for a space between the side wall 535 of the second portion 545 of the recess 530 and the side wall 111 of the cartridge 10 (using cartridge 10 as example). In additional embodiments, the second portion 545 is designed to allow for a space between the bottom of 532 the second portion 545 of the recess 530 and the bottom surface 120 of the cartridge 10 (using cartridge 10 as example).

The pipe 50 can have a channel 550 formed therein that extends from the bottom 532 of the recess 530, along the length of the body 510, and to a side wall 511 of the body 510 that forms an opening 551. The channel 550 can have a constant diameter along the length of the body 510. In embodiments, the channel 550 is tubular in shape; however, it is contemplated that the channel 550 can have any shape. In embodiments, the wall 552 of the channel 550 can have indentations (for example, as described for the cartridge 30) formed therein so as to increase the contact surface area of the smoke with the wall 552 of the channel 550. Indentations can contribute to a cooling effect of the smoke in the channel 550 by conducting heat through the body 110 of the pipe 50.

In embodiments, the body 510 can have a length in a range of 3 inches to 8 inches, a height in a range of 1 inch to 3 inches, and a width in a range of 1 inch to 3 inches.

A user of the pipe 50 can place their mouth on the opening 551 in order to inhale smoke generated by combustion of a smokable medium that is in a cartridge held in the recess 530, where the smoke flows into the bottom 532 of the recess 530, through the channel 550, and out of the opening 551 in the side wall 511 of the body 510.

In optional embodiments, the pipe 50 can include a lid 520. The lid is generally a flat piece of material that can be placed on the top surface 521 of the body 510 so as to cover the recess 530. In embodiments, the lid 520 can be formed of wood, plastic, metal, or a combination thereof. In some embodiments, the lid 520 can be formed of a metal that is attracted to magnets.

In embodiments, the lid 520 can have a hole 570 formed therein that is configured to allow air to enter the recess 530 of the body 510 of the pipe 50 and to allow smoke to escape the recess 30 of the body 510. The hole 570 can have any shape, for example, circular, square, triangular, rectangular, other polygon-shaped, star-shaped, cross-shaped. The size of the hole 570 is configured such that i) smokable medium does not fall out of the cartridge 10 through the hole 570 when the lid 520 is placed over the recess 530, ii) air can enter the hole 570 when a user is inhaling smoke from the opening 551, and iii) smoke can escape the recess 530 of the pipe 50 through the hole 570 when a user is not inhaling smoke from the opening 551.

In embodiments, the hole 570 can be circular in shape and have a diameter in a range 2.946 mm to 3.048 mm; alternatively, about 3 mm. It has been found that a diameter of less than 2.946 mm chokes down the inhalation draw when a user inhales smoke from the pipe 50. Moreover, it has been found that a diameter of more than 3.048 mm allows smokable medium to fall out of the cartridge placed in the pipe 50.

In additional or alternative embodiments, the hole 570 can have a cross-sectional area in a range of 3.14 $mm^2$ to 12.57 $mm^2$; alternatively, about 7 $mm^2$; alternatively, about 7.1 $mm^2$; alternatively, about 7.2 $mm^2$; alternatively, about 7.3 $mm^2$; alternatively, equal to or greater than 6.61 $mm^2$ and equal to or less than 7.55 $mm^2$; alternatively, equal to or greater than 6.79 $mm^2$ and equal to or less than 7.31 $mm^2$; alternatively, equal to or greater than 6.82 $mm^2$ and equal to or less than 7.30 $mm^2$.

In embodiments where the pipe has a lid 520, the pipe 50 can have one or more magnets 560 embedded in the top surface 521 of the body 510. Each magnet 560 can be configured to engage with the lid 520 so as to hold the lid 520 onto the body 510 of the pipe 50 for smoking and for storage of the pipe 50.

In optional embodiments, the pipe 50 can have one or more magnets embedded on a side wall (e.g., a side wall that is perpendicular to side wall 511) of the body 510 and be configured to hold a lighter on the side of the body 510 via magnetic attraction.

Pipe 50 can be used by first removing the lid 520. A cartridge 10, 20, 30, or 40 can be selected by the user, and cartridge 10 is used as an example. The user can remove the top cover 130 and the bottom cover 140 from the cartridge 10 prior to placing the cartridge 10 into the pipe 50. The cartridge 10 can then be placed in recess 530 such that the side wall 111 of the cartridge 10 contacts the point 536 of the recess 530. The smokable medium inside the cartridge 10 may be lit using a lighter or matched through the access opening 150 of the cartridge 10 while the cartridge is in the recess 530. The lid 520 can then be placed such that the hole 570 of the lid 520 is above the recess 530 of the body 510. The user can then inhale the smoke generated by combustion of the smokable medium in the cartridge 10 through the opening 551 and the channel 550.

FIG. 6 depicts a different embodiment of a pipe 60 according to the disclosure. Pipe 60 has the body 510, lid 520, channel 550, opening 551, and optional magnets 560 as described for the pipe 50 in FIG. 5. The description for these parts is not reproduced here. The pipe 60 depicted in FIG. 6 has a different recess 630. As shown in FIG. 6, the recess 630 can have a first portion 540, a second portion 645 below the first portion 540, and third portion 680 below the second portion 645. The first portion 540 is similar to the first portion 540 in the recess 530 shown in FIG. 5; however, the second portion 645 of the recess 630 is similar to the second portion 545 in recess 530, except that second portion 645 in FIG. 6 has a smaller height so that the recess 630 can include the third portion 680 below the second portion 645. A ledge 533 is formed on the bottom of the first portion 540, and a point 536 is formed between the side wall 635 of the second portion 645 and the ledge 533.

The side wall 681 of the third portion 680 of the recess 630 can be angled or tapered relative to a side wall of a cartridge placed in the recess 630. For example, the side wall 681 can be substantially vertical while the side wall of a cartridge is tapered, the side wall 681 can be angled or tapered such that the top 682 of the third portion 680 has a diameter that is smaller than a bottom 683 of the third portion 680, or both. The third portion 680 is designed to allow for a space between the side wall 681 of the third portion 680 of the recess 630 and the side wall 111 of the cartridge 10 (using cartridge 10 as example). In additional embodiments, the third portion 680 is designed to allow for a space between the side wall 681 of the third portion 680 of the recess 630 and the bottom surface 120 of the cartridge 10 (using cartridge 10 as example).

Embodiments of the disclosure also contemplate a recess that includes the first portion 540 and third portion 680 below the first portion 540, but not the second portion 645 shown in FIG. 6. That is, embodiments of the disclosure include a recess having a first portion and second portion below the first portion, where the second portion increases in diameter from a top to a bottom (the top has a diameter that is greater than a diameter of the bottom of the second portion).

In embodiments, the bottom surface 120 of cartridges 10, 20, and 40 does not touch a bottom surface 631 of the recess 630. In embodiments, the bottom surface 320 of cartridge 30 does not touch the bottom surface 631 of the recess 630.

In embodiments, the bottom surface 631 of the recess 630 can have indentations (for example, as described for the cartridge 30) formed therein so as to increase the contact surface area of the smoke with the bottom surface 631. Indentations can contribute to a cooling effect of the smoke in the recess 630 by conducting heat through the body 510 of the pipe 60. In embodiments, the channel 550 of the pipe 60 in FIG. 6 can have indentations as described for the channel 550 of pipe 50 in FIG. 5.

FIG. 7 depicts an alternative embodiment of a pipe 70 according to the disclosure. The pipe 70 is the same configuration as that illustrated and described in FIG. 6, except the pipe 70 additional includes a storage recess 790 formed in the top surface 521 of the body 510. The storage recess 790 is configured to hold an unused or used cartridge. The storage recess 790 can have any shape and size that is configured to store the used or unused cartridge. The storage recess 790 is generally formed in the body 510 such that the storage recess 790 is not fluidly connected to the recess 630, channel 550, and opening 551. Embodiments of the disclosure contemplate that additional storage recesses can be formed in the top surface 521 of the body 510, limited only by the number of storage recesses that can fit along the length of the body 510 that is not used by recess 630.

Figure 8:
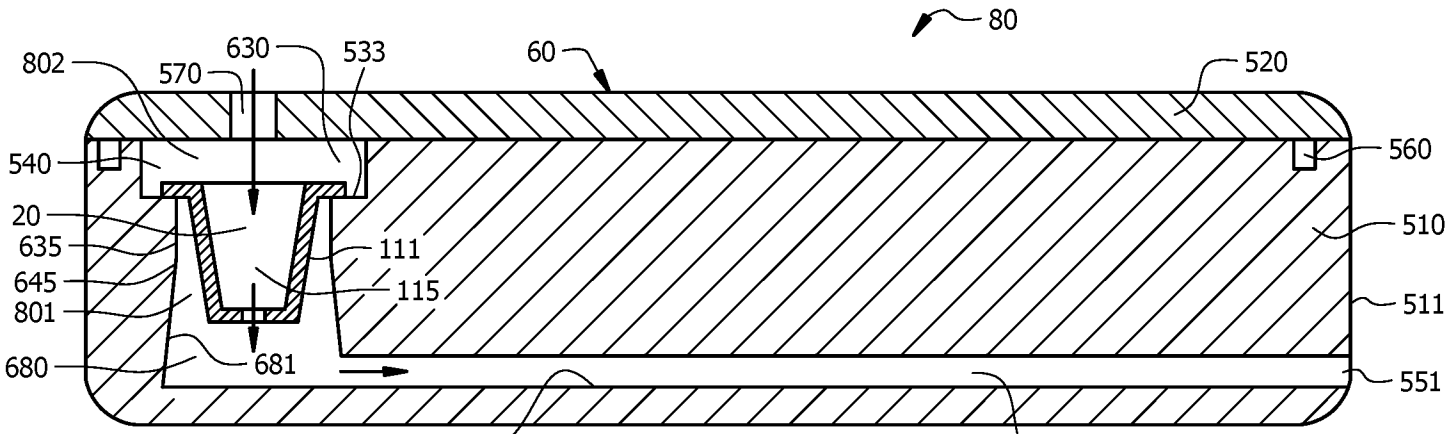
FIG. 8 depicts a cross-sectional view of a pipe and cartridge system according to the disclosure.

FIG. 8 depicts an embodiment of a pipe and cartridge system 80. The pipe and cartridge system 80 includes the pipe 60 of FIG. 6 and the cartridge 20 of FIGS. 2A and 2B, for exemplary purposes only. The pipe and cartridge system 80 can alternatively include any embodiment of pipe disclosed herein in combination with any embodiments of cartridge disclosed herein.

The pipe 60 has the recess 630 described in FIG. 6, and cartridge 20 has been inserted into the recess 630 so that the ledge 533 of the first portion 540 of the recess 630 holds the lip 210 of the cartridge 20. The lid 520 is placed on the body 510, and is held on the body 510 by the magnets 560.

When combusting a smokable medium in the pipe and cartridge system 80, air and smoke flow in the direction of the arrows shown in FIG. 8 when a user inhales via the opening 551.

The space 801 created between the side wall 681 of the recess 630 and the side wall 111 of the cartridge 20 allows swirling of air and smoke in the space 801 which removes heat from the side wall 111 of the cartridge 20 by convection. Removal of the heat from the side wall 111 of the cartridge 20 via convection cools the cartridge 20 and the contents of the cartridge 20, and it is believed the cooling results in a cooler combustion temperature of the smokable medium in the cartridge 20. The lower combustion temperature produces a cooler smoke inhaled from the pipe 60 via the opening 551 and the channel 550. This cooling effect can be further increased by using cartridge 30 or cartridge 40 with heat transfer elements (e.g., indentations 370 or protrusions 480) that increase the heat transfer surface area of the side wall 311 or 111 of the cartridge 30 or 40, respectively, relative to the surface area of the side wall 111 of cartridge 20. It is believed, as discussed for cartridges 30 and 40 above, that the increased surface area provides more contact area for heat out of the cartridge 30 or 40 into the space 801, which provides a lower combustion temperature for the smokable medium in the cartridge 30 or 40, and which produces a cooler smoke. While the space 801 between the side wall 681 of the recess 630 and the side wall 111 of the cartridge 20 is illustrated for system 80, it is believed that a space created between the side wall of any cartridge disclosed herein and the side wall of any recess configuration disclosed herein can produce a lower combustion temperature of smokable medium in the cartridge, which produces a cooler smoke.

In embodiments, the space 802 in the recess 630 that is between the lid 520 and the cartridge 20 allows for swirling of air and smoke, which it believed to remove heat from the hollow interior 115 of the cartridge 20. When a user is not inhaling, air and smoke can exit the space 802 via the hole 570 formed in the lid 520.

It is also believed that using the lid 520 having the hole 570 formed therein limits the supply of oxygen to the burning smokable medium, which in turn reduces the rate of smokable medium combustion in the cartridge 20, which reduces the heat emission rate during smokable medium combustion. The reduction in heat emission rate is believed to also contribute to a lower smoke temperature, i.e., a cooler smoke, when inhaling smoke via the pipe 60.

Disclosed herein is a method for forming any embodiment of the cartridge disclosed herein. The method can include creating a cartridge body having at least one side wall, a bottom surface connected to a bottom of the at least one side wall, and an access opening on a top of the at least one side wall, wherein the bottom surface has a hole formed therein; filling the cartridge body with the smokable medium; applying a bottom cover to the bottom surface so that the hole is covered by the bottom cover; and applying a top cover to a top surface of the at least one side wall such that the access opening is covered by the top cover. The method can also include labeling the cartridge with product and dosage information. The smokable medium can be a product of a Nicotiana plant or cannabis.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A pipe for smoking a smokable medium, the pipe comprising:

a pipe body comprising:

a recess formed in a top surface of the pipe body, wherein the recess is configured to hold a cartridge containing the smokable medium such that a first space is formed between a side wall of the recess and a side wall of the cartridge, wherein the first space is configured to allow swirling of smoke and air between the side wall of the recess and the side wall of the cartridge to remove heat from the side wall of the cartridge;

a channel formed in the body and configured to extend from a bottom of the recess to an opening formed in a side wall of the pipe body; and a lid configured to cover the top surface of the pipe body, wherein the lid has only one hole formed therein, wherein the lid and the hole formed in the lid are positioned over the recess when the lid is placed on the pipe body, wherein the hole has a diameter in a range of from 2.946 mm to 3.048 mm.

2. The pipe of claim 1, wherein the recess has a first portion and a second portion below the first portion, wherein the second portion has a diameter that is less than a diameter of the first portion, wherein a top of the second portion has a diameter than is less than a diameter of a bottom of the second portion, wherein the second portion has the side wall of the recess by which the first space is formed between the side wall of the recess and the side wall of the cartridge.

3. The pipe of claim 2, where a side wall of the second portion is angled relative to the side wall of the cartridge.

4. The pipe of claim 1, wherein the recess has a first portion, a second portion below the first portion, and a third portion below the second portion, wherein the third portion or the second portion has the side wall of the recess by which the first space is formed between the side wall of the recess and the side wall of the cartridge.

5. The pipe of claim 1, further comprising:

at least one magnet embedded in the top surface of the body, the at least one magnet configured to couple with the lid.

6. The pipe of claim 1, further comprising:

at least one additional recess formed in the top surface of the body, wherein the at least one additional recess is configured to hold an additional cartridge.

7. A pipe and cartridge system comprising a cartridge for a smokable medium and the pipe of claim 1.

8. The pipe of claim 1, wherein the lid is configured such that a second space in the recess is formed between the cartridge and the lid, wherein the second space is configured to allow swirling of smoke and air between the cartridge and the lid.

9. The pipe of claim 8, wherein the recess has a first portion, a second portion below the first portion, and a third portion below the second portion, wherein the first portion contains the second space, wherein the second portion or the third portion has the side wall of the recess by which the first space is formed between the side wall of the recess and the side wall of the cartridge.

10. The pipe of claim 9, wherein a bottom surface of the cartridge does not touch a bottom surface of the recess.

11. The pipe of claim 9, wherein the side wall of the recess does not touch the side wall of the cartridge.

12. The pipe of claim 9, wherein a ledge is formed at a bottom surface of the first portion where the first portion meets the second portion, wherein the second space is above the ledge.

13. The pipe of claim 8, wherein the recess has a first portion and a second portion below the first portion, wherein the first portion contains the second space, wherein the second portion has the side wall of the recess by which the first space is formed between the side wall of the recess and the side wall of the cartridge.

14. The pipe of claim 13, wherein a bottom surface of the cartridge does not touch a bottom surface of the recess.

15. The pipe of claim 13, wherein the side wall of the recess does not touch the side wall of the cartridge.

16. The pipe of claim 13, wherein a ledge is formed at a bottom surface of the first portion where the first portion meets the second portion.

17. The pipe of claim 16, wherein the second space is above the ledge.

18. The pipe of claim 1, wherein a shape of the recess is not the same as a shape of the cartridge.

19. The pipe of claim 1, wherein the first space is formed entirely around the side wall of the cartridge.

* * * * *